US005598987A

United States Patent [19]

Wachowicz

[11] Patent Number: 5,598,987

[45] Date of Patent: Feb. 4, 1997

[54] DISPENSER FOR ROLLED PAPER PRODUCTS

[76] Inventor: Walter J. Wachowicz, 708 Amos St., Rocky Mount, N.C. 27803

[21] Appl. No.: 530,988

[22] Filed: Sep. 20, 1995

[51] Int. Cl.[6] ..... B65H 16/04; B65H 18/04

[52] U.S. Cl. ..... 242/597.8; 242/905

[58] Field of Search ..... 242/597.8, 598.6, 242/596.8, 590, 905; D6/523

[56] References Cited

U.S. PATENT DOCUMENTS

| | | | |
|---|---|---|---|
| 2,737,353 | 3/1956 | Banks, Jr. | 242/598.6 X |
| 2,752,106 | 6/1956 | Thompson | 242/598.6 X |
| 4,106,617 | 8/1978 | Boone | 242/905 X |
| 4,936,452 | 6/1990 | Pauley | 242/598.6 X |

*Primary Examiner*—John Q. Nguyen

[57] ABSTRACT

A dispenser for rolled paper products. Such dispenser consists of a primary cylinder of a rigid material formed in a cylindrical configuration and positionable about a horizontal axis, the cylinder having a closed first end and an opened second end with screw threads, the cylinder also having a cylindrical spindle with a free end located adjacent the opened end of the cylinder and having a secured end mounted to the central portion of the closed end of the cylinder, the spindle adapted to receive a roll of paper to be dispensed; and an intermediate end cap formed of a short cylindrical configuration with screw threads on its periphery adapted to be removably received by the screw threads at the open end of the cylinder, a central aperture formed at the center of the intermediate cap with threads.

2 Claims, 3 Drawing Sheets

DISPENSER FOR ROLLED PAPER PRODUCTS

BACKGROUND OF THE INVENTION

1. Field of the Invention

The present invention relates to a dispenser for rolled paper products with capabilities for a fragrance and viewing the remaining paper and, more particularly, pertains to dispensing paper conveniently while viewing the remaining paper on the roll and while allowing a fragrance to permeate the paper and the environment.

2. Description of the Prior Art

The use of dispensers for rolled toilet paper and like materials of various designs and configurations is known in the prior art. More specifically, dispensers for rolled toilet paper and like materials of various designs and configurations and heretofore devised and utilized for the purpose of extending the usability of paper dispensers through various methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,804,149 to Murphy a toilet paper dispenser with flat side walls and a U-shaped front wall.

U.S. Pat. No. 4,909,415 to Michel discloses a device for dispensing paper, particularly toilet paper.

U.S. Pat. No. 5,170,958 to Brown discloses a toilet paper dispenser suspended from a wall mounted holder.

U.S. Pat. No. Des. 302,504 to Levy discloses another toilet paper dispenser with an ornamental design.

Lastly, U.S. Pat. No. Des. 310,759 to Breger discloses an ornamental design for a toilet paper dispenser.

In this respect, the dispenser for rolled paper products according to the present invention substantially departs from the conventional concepts and designs of the prior art, and in so doing provides an apparatus primarily developed for the purpose of dispensing paper conveniently while viewing the remaining paper on the roll and while allowing a fragrance to permeate the paper and the environment.

Therefore, it can be appreciated that there exists a continuing need for a new and improved dispenser for rolled paper products which can be used for dispensing paper conveniently while viewing the remaining paper on the roll and while allowing a fragrance to permeate the paper and the environment. In this regard, the present invention substantially fulfills this need.

SUMMARY OF THE INVENTION

In view of the foregoing disadvantages inherent in the known types of dispensers for rolled toilet paper and like materials of various designs and configurations now present in the prior art, the present invention provides an improved dispenser for rolled paper products with capabilities for a fragrance and viewing the remaining paper. As such, the general purpose of the present invention, which will be described subsequently in greater detail, is to provide a new and improved dispenser for rolled paper products and method which has all the advantages of the prior art and none of the disadvantages.

To attain this, the present invention essentially comprises a new and improved dispenser for rolled paper products with capabilities for a fragrance and viewing the remaining paper comprising, in combination, a primary cylinder of a rigid material formed in a cylindrical configuration and positionable about a horizontal axis, the cylinder having a closed first end and an opened second end with internal screw threads, the cylinder also having a cylindrical spindle with a free end located adjacent the opened end of the cylinder and having a secured end mounted to the central portion of the closed end of the cylinder, the spindle adapted to receive a roll of paper to be dispensed; an intermediate end cap formed of a short cylindrical configuration with external screw threads on its periphery adapted to be removably received by the screw threads at the open end of the cylinder, a central aperture formed at the center of the intermediate cap with threads; a hollow cylindrical container with external screw threads secured to the intermediate cap at its aperture with a threaded end cap adapted to be positioned over the intermediate cap for maintaining potpourri therein to emit a fragrance; a mounting bracket in a generally Z-shaped cross-sectional configuration secured to the cylinder at rear exterior surface thereof; a complimentary bracket secured to a recipient surface with a Z-shaped recess adapted to slidably receive the Z-shaped bracket secured to the cylinder; an axial slot formed in the surface of the cylinder in a lower forward region thereof for the passage of sheet material therefrom; a closure on the exterior surface of the cylinder surrounding the axial slot, the closure having a fixed lower section with a finger groove therethrough for advancing paper therefrom and an associated pivotal upper section thereabove to allow access to the paper therein, the leading edge of the fixed and movable section being formed with serrations to allow the separation of an exposed sheet of paper from the remainder of the roll; and a window formed in the cylinder at a front upper surface thereof for determining the quantity of sheet material remaining on the spindle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dispenser for rolled paper products with capabilities for a fragrance and viewing the remaining paper which has all the advantages of the prior art dispensers for rolled toilet paper and like materials of various designs and configurations and none of the disadvantages.

It is another object of the present invention to provide a new and improved dispenser for rolled paper products with capabilities for a fragrance and viewing the remaining paper which may be easily and efficiently manufactured and marketed.

It is a further object of the present invention to provide a new and improved dispenser for rolled paper products with capabilities for a fragrance and viewing the remaining paper which is of a durable and reliable construction.

An even further object of the present invention is to provide a new and improved dispenser for rolled paper products with capabilities for a fragrance and viewing the remaining paper which is susceptible of a low cost of manufacture with regard to both materials and labor, and which accordingly is then susceptible of low prices of sale to the consuming public, thereby making such dispensers for rolled toilet paper and like materials of various designs and configurations economically available to the buying public.

Still yet another object of the present invention is to provide a new and improved dispenser for rolled paper products with capabilities for a fragrance and viewing the remaining paper which provides in the apparatuses and methods of the prior art some of the advantages thereof, while simultaneously overcoming some of the disadvantages normally associated therewith.

Even still another object of the present invention is to dispense paper conveniently while viewing the remaining paper on the roll and while allowing a fragrance to permeate the paper and the environment.

Lastly, it is an object of the present invention to provide a dispenser for rolled paper products having a primary cylinder of a rigid material formed in a cylindrical configuration and positionable about a horizontal axis, the cylinder having a closed first end and an opened second end with screw threads, the cylinder also having a cylindrical spindle with a free end located adjacent the opened end of the cylinder and having a secured end mounted to the central portion of the closed end of the cylinder, the spindle adapted to receive a roll of paper to be dispensed; and an intermediate end cap formed of a short cylindrical configuration with screw threads on its periphery adapted to be removably received by the screw threads at the open end of the cylinder, a central aperture formed at the center of the intermediate cap with threads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
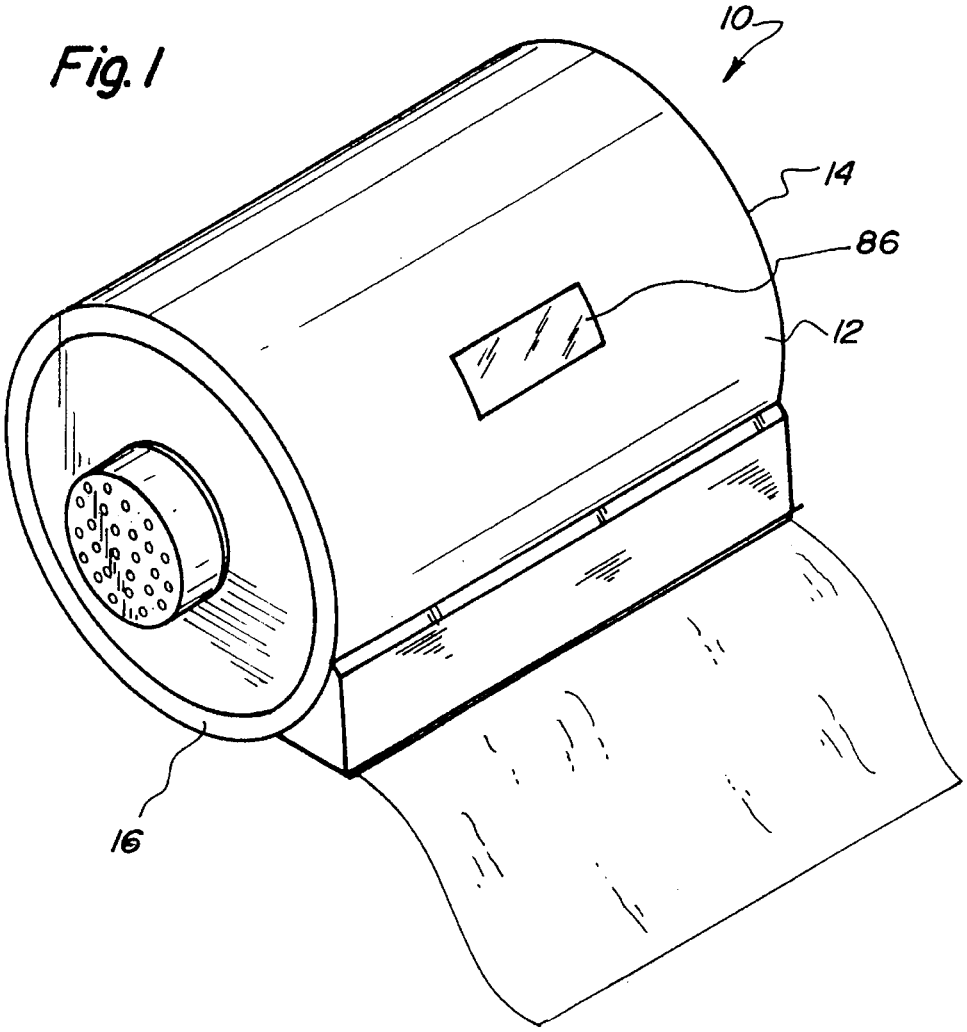
FIG. 1 is a perspective illustration of the preferred embodiment of the new and improved dispenser for rolled paper products with capabilities for a fragrance and viewing the remaining paper constructed in accordance with the principles of the present invention.
Figure 2:
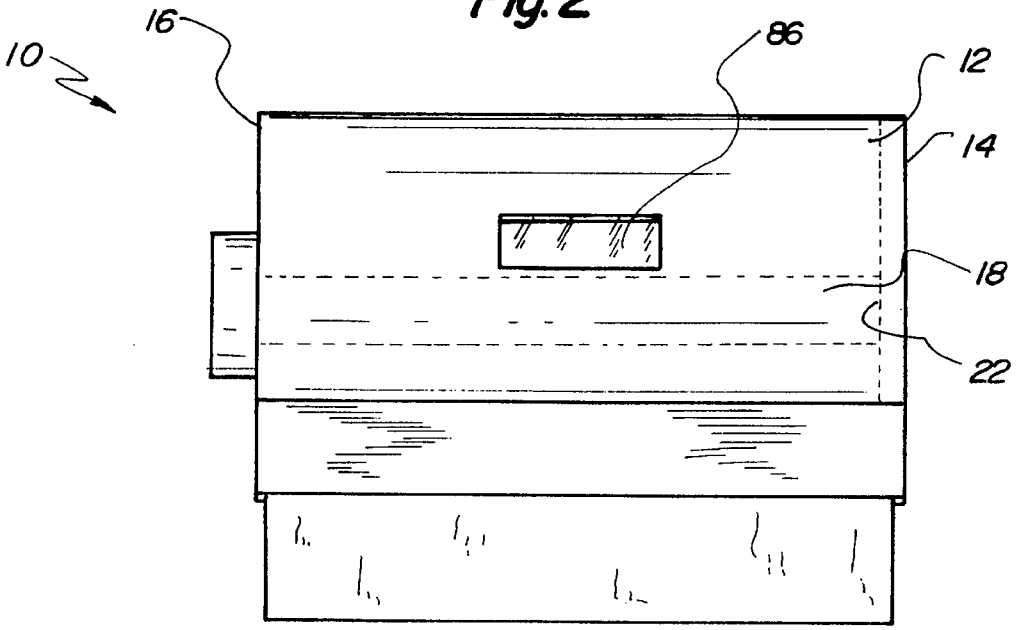
FIG. 2 is a front elevational view of the device shown in FIG. 1.

With reference now to the drawings, and in particular to FIG. 1 thereof, the preferred embodiment of the new and improved dispenser for rolled paper products with capabilities for a fragrance and viewing the remaining paper embodying the principles and concepts of the present invention and generally designated by the reference numeral 10 will be described.

The present invention, the new and improved dispenser for rolled paper products with capabilities for a fragrance and viewing the remaining paper, is a system 10 comprised of a plurality of components. In their broadest context, the components include a container, an end cap, a hollow cylindrical container, a mounting bracket, a complimentary bracket, an axial slot, a closure and a viewing window. Each of the individual components is specifically configured and correlated one with respect to the other so as to attain the desired objectives.

More specifically, the present dispenser is a system 10 which has as its central component a primary container cylinder 12. The primary cylinder is formed of a rigid material in a cylindrical configuration. The material may be any conventional wood or plastic or other rigid material which suits the purpose and which may be provided with decorations to enhance the appeal of the container. The cylinder is positionable about its central axis in a horizontal orientation. The container is provided with a closed first end 14. Opposite such end is an open second end 16 with internal screw threads. The cylinder also has a cylindrical spindle 18. Such spindle has a free end 20 located adjacent the open end of the cylinder and extending to a common distance. The spindle also has a secured end 22 mounted to the central portion of the closed end of the cylinder. Such spindle is adapted to receive a roll of paper 24 to be dispensed. The dispensed material may be toilet tissue, paper towels or the like.

Next provided is an enlarged intermediate cap 38. Such end cap is formed in a short cylindrical configuration. It is provided with external screw threads 40 on its periphery. Such threads are adapted to be removably received by the screw threads 42 at the open end of the cylinder. A central aperture 44 is formed at the center of the intermediate cap. Such central aperture is provided with threads 46.

Next provided is a hollow cylindrical container 52 with external screw threads. Such container is secured to the intermediate cap at its aperture. A small threaded end cap 54 is adapted to be positioned over the large intermediate cap for maintaining potpourri 56 or other fragrant material therein. Its function is to emit a fragrance.

Figure 3:
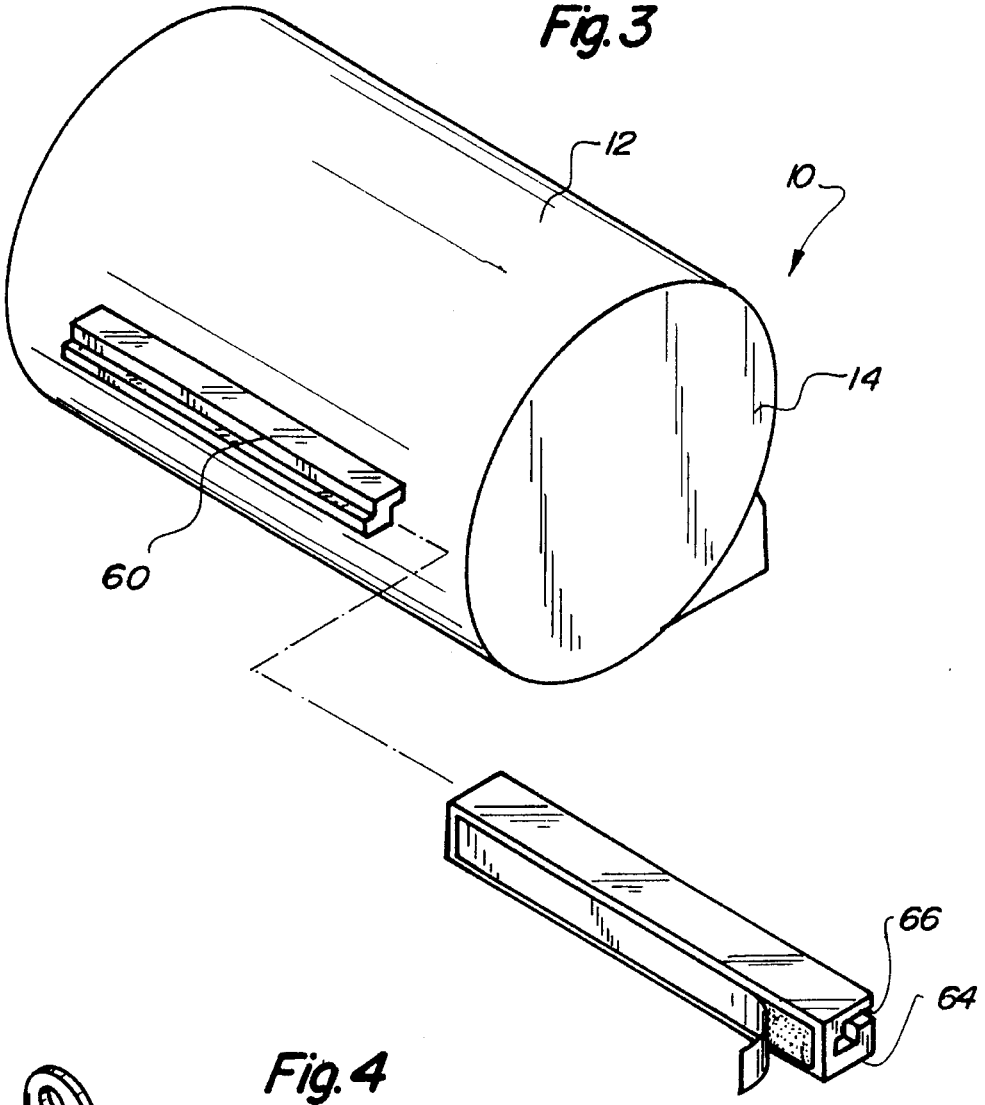
FIG. 3 is an exploded rear elevational view of the apparatus shown in FIGS. 1 and 2 but also illustrating a supporting component.
Figure 4:
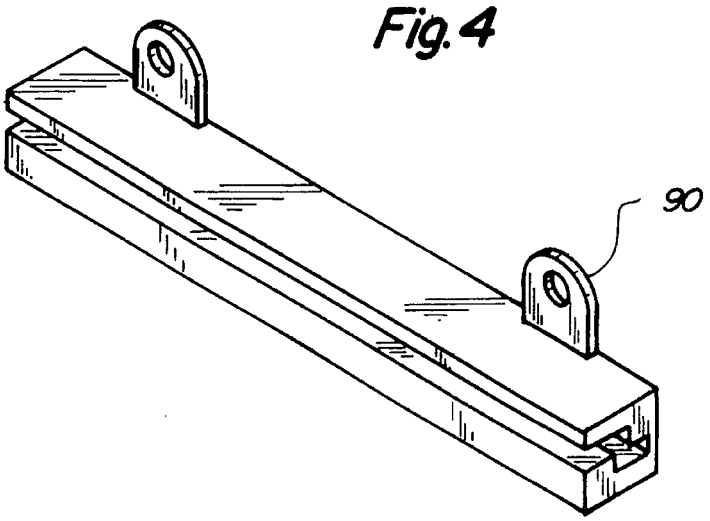
FIG. 4 is a perspective view of an alternate embodiment of the supporting component shown in FIG. 3.
Figure 5:
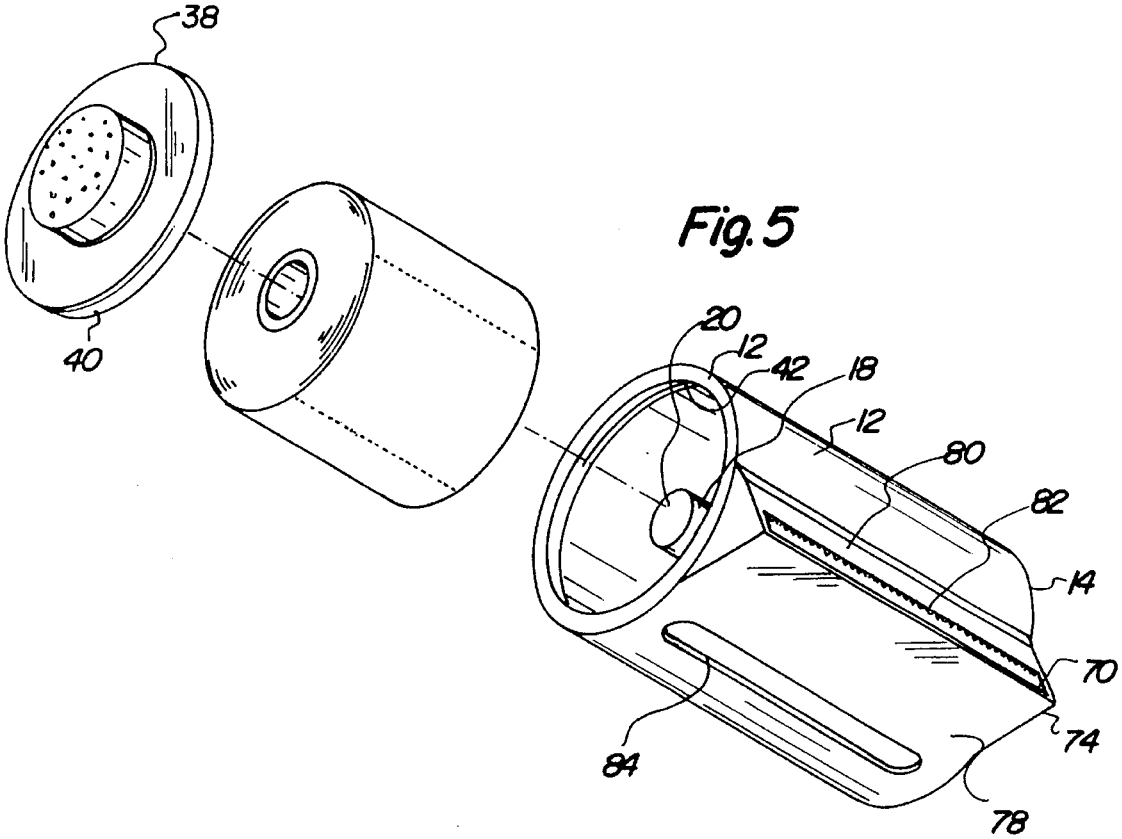
FIG. 5 is an exploded perspective view of the device shown in FIGS. 1, 2 and 3.
Figure 6:
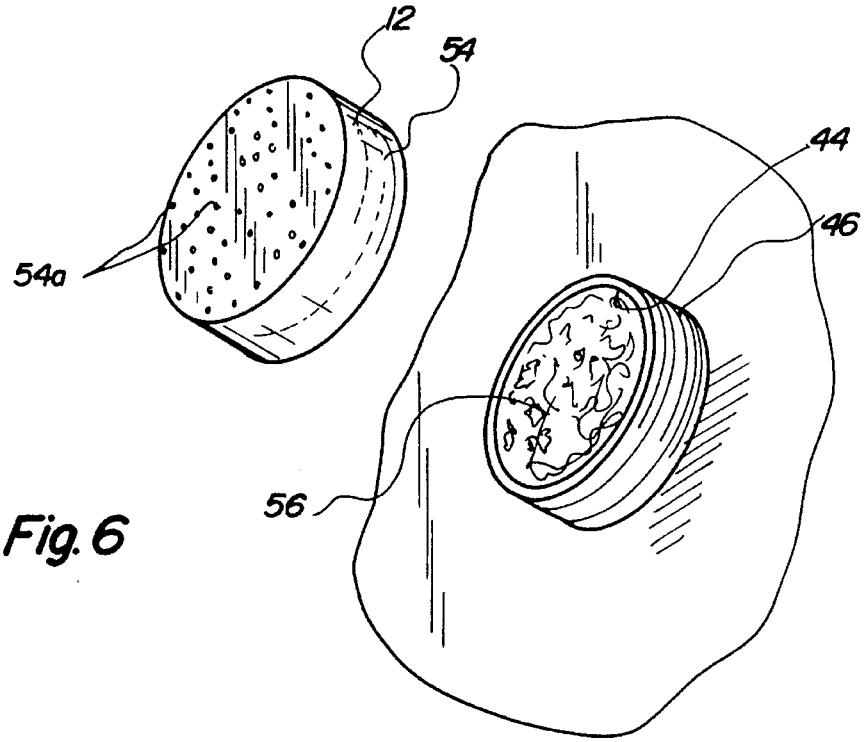
FIG. 6 is an exploded perspective view of the end cap shown in FIG. 5.

Proper positioning of the apparatus is effected through a mounting bracket 60. Such bracket is in a generally Z-shaped cross-sectional configuration. It is secured to the cylinder at a rear exterior surface of the cylinder. Note FIGS. 3 and 4.

In association with the mounting bracket is a complimentary bracket 64. Such complimentary bracket is secured to a recipient surface such as a wall. The complimentary bracket is formed with a Z-shaped recess 66. Such Z-shaped recess is adapted to slidably receive the Z-shaped bracket secured to the cylinder.

Formed in the cylinder is an axial slot 70. Such slot is formed in the exterior surface of the cylinder in a lower forward region thereof. The purpose of such slot is for the passage of sheet material on the spindle to exterior of the cylinder for use by a user.

Next provided is a closure 74. Such closure is located on the exterior surface of the cylinder. It is configured to surround the axial slot. The closure has a fixed lower section 78 with a finger groove 84 therethrough. Such finger groove is for advancing paper from the roll of paper on the spindle. In addition, an associated pivotal upper section 80 is located thereabove. The purpose of such pivotal section is to allow access by a user to the paper therein for replenishing depleted rolls. The leading edge of the fixed and movable sections are formed with serrations 82. The serrations function to allow separation of the exposed sheet of paper from the remainder of the roll.

Lastly provided is a window 86. The window includes a transparent panel in an opening in the cylinder. The window is formed into the cylinder at a front upper surface thereof. It functions to provide viewing capability. In this manner, a user may determine the quantity of sheet material on the roll being dispensed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dispenser for rolled paper products with capabilities for a fragrance and viewing the remaining paper comprising, in combination:

a primary cylinder of a rigid material formed in a cylindrical configuration and positionable about a horizontal axis, the cylinder having a closed first axial end and an opened second axial end with internal screw threads, the cylinder also having a cylindrical spindle with a free end located adjacent the opened end of the cylinder and having a secured end mounted to the central portion of the closed end of the cylinder, the spindle adapted to receive a roll of paper to be dispensed;

an intermediate end cap formed of a short cylindrical configuration with external screw threads on a periphery thereof adapted to be removably received by the screw threads at the open end of the cylinder, a central aperture formed at the center of the intermediate cap and having threads;

a hollow cylindrical container with external screw threads secured to the intermediate cap at the central aperture; a threaded end cap adapted to be mated to the hollow cylindrical container for maintaining potpourri therein to emit a fragrance, the threaded end cap having a plurality of apertures therethrough;

a mounting bracket in a generally Z-shaped cross-sectional configuration secured to the cylinder at a rear exterior surface thereof;

a complimentary bracket secured to a recipient surface with a Z-shaped recess adapted to receive the Z-shaped bracket secured to the cylinder;

an axial slot formed in the surface of the cylinder in a lower forward region thereof for the passage of sheet material therefrom;

a closure on the exterior surface of the cylinder surrounding the axial slot, the closure having a fixed lower section with a finger groove therethrough for advancing paper therefrom and an associated pivotally upper section thereabove to allow access to the paper therein, the adjacent leading edges of the fixed and movable sections being formed with serrations to allow the separation of an exposed sheet of paper from the remainder of the roll; and a window formed in the cylinder at a front upper surface thereof for determining the quantity of sheet material remaining on the spindle.

2. A dispenser for rolled paper products comprising:

a primary cylinder of a rigid material formed in a cylindrical configuration and positionable about a horizontal axis, the cylinder having a closed first end and an opened second end with screw threads, the cylinder also having a cylindrical spindle with a free end located adjacent the opened end of the cylinder and having a secured end mounted to the central portion of the closed end of the cylinder, the spindle adapted to receive a roll of paper to be dispensed;

an intermediate end cap formed of a short cylindrical configuration with screw threads on a periphery thereof adapted to be removably received by the screw threads at the open end of the cylinder, a central aperture formed at the center of the intermediate cap and having threads; and a hollow cylindrical container with screw threads secured to the intermediate cap at the central aperture with a threaded end cap to be mated to the hollow cylindrical container for maintaining potpourri therein to emit a fragrance, the threaded end cap having a plurality of apertures therethrough.

* * * * *